US008647183B2

(12) United States Patent
Swofford

(10) Patent No.: US 8,647,183 B2
(45) Date of Patent: Feb. 11, 2014

(54) AIR CURTAIN SYSTEM FOR A REFRIGERATED CASE

(75) Inventor: Timothy Dean Swofford, Midlothian, VA (US)

(73) Assignee: Hill Phoenix, Inc., Conyers, GA (US)

( * ) Notice: Subject to any disclaimer, the term of this patent is extended or adjusted under 35 U.S.C. 154(b) by 1228 days.

(21) Appl. No.: 11/918,528

(22) PCT Filed: Apr. 13, 2006

(86) PCT No.: PCT/US2006/014038
§ 371 (c)(1),
(2), (4) Date: Feb. 12, 2009

(87) PCT Pub. No.: WO2006/115824
PCT Pub. Date: Nov. 2, 2006

(65) Prior Publication Data

US 2009/0215381 A1 Aug. 27, 2009

Related U.S. Application Data

(60) Provisional application No. 60/674,513, filed on Apr. 25, 2005, provisional application No. 60/722,142, filed on Sep. 30, 2005.

(51) Int. Cl.
*F24F 9/00* (2006.01)
*A47F 3/04* (2006.01)

(52) U.S. Cl.
CPC ..... *A47F 3/0447* (2013.01)
USPC ..... 454/193; 62/82; 62/89

(58) Field of Classification Search
USPC ..... 454/193; 62/234, 246, 256
See application file for complete search history.

(56) References Cited

U.S. PATENT DOCUMENTS

| | | | | | |
|---|---|---|---|---|---|
| 2,862,369 | A | * | 12/1958 | Simons | 62/89 |
| 3,063,256 | A | * | 11/1962 | Lamb | 62/256 |
| 3,130,559 | A | | 4/1964 | Beckwith | |
| 3,224,219 | A | * | 12/1965 | Boren | 62/278 |
| 3,250,085 | A | * | 5/1966 | Mercer, Sr. | 62/256 |
| 3,256,799 | A | | 6/1966 | Beckwith et al. | |
| 3,270,655 | A | | 9/1966 | Guirl et al. | |
| 3,304,736 | A | * | 2/1967 | Brennan et al. | 62/176.1 |
| 3,326,012 | A | * | 6/1967 | Asker et al. | 62/78 |
| 3,365,908 | A | | 1/1968 | MacMaster | |

(Continued)

FOREIGN PATENT DOCUMENTS

| | | | | |
|---|---|---|---|---|
| EP | 0 334 678 | A1 | 9/1989 | |
| EP | 583152 | A1 * | 2/1994 | F25B 6/00 |

(Continued)

OTHER PUBLICATIONS

U.S. Appl. No. 12/506,984, filed Jul. 21, 2009, Swofford et al.

(Continued)

*Primary Examiner* — Steven B McAllister
*Assistant Examiner* — Frances H Kamps
(74) *Attorney, Agent, or Firm* — Foley & Lardner LLP

(57) ABSTRACT

A refrigerated display case, an air curtain system, and a method of providing an air curtain are provided. The air curtain is suitable for use with a refrigerated display case of the type having an open front, including those with a door selectively covering the open-front. The air curtain includes a secondary layer formed of ambient air cooled by exposure to a refrigerated primary layer.

12 Claims, 4 Drawing Sheets

(56) References Cited

U.S. PATENT DOCUMENTS

| | | | | |
|---|---|---|---|---|
| 3,403,525 | A | 10/1968 | Beckwith et al. | |
| 3,771,323 | A | 11/1973 | Simons et al. | |
| 3,937,033 | A | 2/1976 | Beckwith et al. | |
| 4,144,720 | A | 3/1979 | Subera et al. | |
| 4,148,197 | A | 4/1979 | Karashima | |
| 4,269,037 | A * | 5/1981 | Karashima | 62/256 |
| 4,326,385 | A | 4/1982 | Ibrahim | |
| 4,414,822 | A | 11/1983 | Ibrahim | |
| 4,478,047 | A * | 10/1984 | Ibrahim | 62/82 |
| 4,648,247 | A | 3/1987 | Takizawa et al. | |
| 4,741,171 | A | 5/1988 | Toshiyuki | |
| 4,750,335 | A | 6/1988 | Wallace et al. | |
| 4,760,708 | A | 8/1988 | Karashima | |
| 4,903,503 | A * | 2/1990 | Meckler | 62/238.3 |
| 4,938,034 | A | 7/1990 | Rosanio et al. | |
| 4,964,281 | A | 10/1990 | Tanaka | |
| 5,048,303 | A | 9/1991 | Campbell et al. | |
| 5,113,749 | A * | 5/1992 | Perbix | 454/193 |
| 5,138,843 | A | 8/1992 | Tamayama et al. | |
| 5,357,767 | A | 10/1994 | Roberts | |
| 5,475,987 | A | 12/1995 | McGovern | |
| 5,475,988 | A | 12/1995 | McGovern | |
| 5,606,863 | A * | 3/1997 | Kicklighter et al. | 62/89 |
| 5,644,831 | A | 7/1997 | Federico | |
| 5,675,983 | A | 10/1997 | Ibrahim | |
| 5,755,108 | A | 5/1998 | Ibrahim et al. | |
| 5,911,744 | A * | 6/1999 | Kawaguchi | 62/89 |
| 5,924,297 | A | 7/1999 | Wolff et al. | |
| 6,151,904 | A | 11/2000 | Jin | |
| 6,381,976 | B1 | 5/2002 | Kempiak et al. | |
| 6,405,548 | B1 | 6/2002 | Hollenbeck | |
| 6,431,060 | B1 | 8/2002 | Gutheim | |
| 6,519,962 | B1 | 2/2003 | Schuetter | |
| 6,539,741 | B2 | 4/2003 | Navarro | |
| 6,619,052 | B1 * | 9/2003 | Nash, Jr. | 62/89 |
| 6,722,149 | B1 | 4/2004 | Saroka et al. | |
| 6,742,344 | B2 * | 6/2004 | Vormedal | 62/89 |
| 6,745,588 | B2 * | 6/2004 | Kahler | 62/246 |
| 6,827,463 | B2 | 12/2004 | Chuang et al. | |
| 6,851,271 | B2 | 2/2005 | Upton et al. | |
| 6,912,864 | B2 | 7/2005 | Roche et al. | |
| 6,955,061 | B2 | 10/2005 | Chiang et al. | |
| 6,959,560 | B2 | 11/2005 | Weikel et al. | |
| 6,993,925 | B2 | 2/2006 | Duffy | |
| 7,010,924 | B2 | 3/2006 | Kempiak | |
| 7,036,947 | B2 | 5/2006 | Chuang et al. | |
| 7,121,104 | B2 | 10/2006 | Howington et al. | |
| 7,159,413 | B2 | 1/2007 | Dail | |
| 7,275,376 | B2 | 10/2007 | Swofford et al. | |
| 7,357,000 | B2 * | 4/2008 | Schwichtenberg et al. | 62/255 |
| 7,497,770 | B2 | 3/2009 | Grassmuck et al. | |
| 7,681,409 | B2 * | 3/2010 | Alahyari et al. | 62/255 |
| 2001/0042383 | A1 | 11/2001 | Chiang et al. | |
| 2001/0042384 | A1 | 11/2001 | Chiang et al. | |
| 2002/0162346 | A1 | 11/2002 | Chiang et al. | |
| 2002/0184904 | A1 | 12/2002 | Wellman | |
| 2003/0159451 | A1 | 8/2003 | Nash, Jr. | |
| 2004/0031280 | A1 * | 2/2004 | Martin et al. | 62/246 |
| 2004/0055321 | A1 | 3/2004 | Kempiak | |
| 2005/0039483 | A1 | 2/2005 | Yun et al. | |
| 2005/0076662 | A1 | 4/2005 | Roche et al. | |
| 2005/0126196 | A1 | 6/2005 | Grassmuck et al. | |
| 2005/0132744 | A1 | 6/2005 | Rohrer et al. | |
| 2005/0138943 | A1 | 6/2005 | Alahyari et al. | |
| 2005/0144966 | A1 | 7/2005 | Upton et al. | |
| 2005/0150241 | A1 | 7/2005 | Upton et al. | |
| 2005/0193755 | A1 | 9/2005 | Duffy | |
| 2006/0242980 | A1 | 11/2006 | Duffy et al. | |
| 2007/0006604 | A1 | 1/2007 | Behr | |
| 2007/0012059 | A1 | 1/2007 | Roche et al. | |
| 2007/0289323 | A1 | 12/2007 | Swofford et al. | |
| 2008/0271473 | A1 | 11/2008 | Fung et al. | |
| 2008/0282719 | A1 | 11/2008 | Fung | |
| 2009/0044553 | A1 | 2/2009 | Tilley | |
| 2009/0084125 | A1 | 4/2009 | Fung | |
| 2009/0205351 | A1 | 8/2009 | Fung | |
| 2009/0215381 | A1 | 8/2009 | Swifford | |
| 2009/0223237 | A1 | 9/2009 | Grassmuck et al. | |
| 2010/0058789 | A1 | 3/2010 | Barreto et al. | |
| 2010/0212343 | A1 | 8/2010 | Swofford et al. | |

FOREIGN PATENT DOCUMENTS

| | | | |
|---|---|---|---|
| EP | 0 768 501 | B1 | 4/1997 |
| FR | 1 324 962 | A | 4/1963 |
| GB | 1 172 217 | A | 11/1969 |
| WO | WO-2006/115824 | A2 | 11/2006 |

OTHER PUBLICATIONS

International Search Report for International Application No. PCT/US2006/014038; mailed Nov. 27, 2006; 2 pages.

* cited by examiner

AIR CURTAIN SYSTEM FOR A REFRIGERATED CASE

CROSS-REFERENCE TO RELATED PATENT APPLICATIONS

This application claims the benefit under 35 U.S.C. §119 (e) of U.S. Provisional Patent Application No. 60/674,513, entitled "Air Curtain for a Refrigerated Case," filed Apr. 25, 2005 and U.S. Provisional Patent Application No. 60/722,142, entitled "Air Curtain System for a Refrigerated Case," filed Sep. 30, 2005, the both of which are incorporated herein by reference in their entirety.

BACKGROUND

The present invention relates to an air curtain system for a refrigerated case. The present invention more specifically relates to a secondary air curtain system for an open-front refrigerated case. The present invention more specifically relates to a secondary air curtain system that recycles ambient air cooled by a primary layer of an air curtain for use as a secondary layer of the air curtain. The present invention also relates to an air curtain system that provides supplemental cooling and/or dehumidification of a stream of ambient air for discharge over a front portion of a case.

It is known to provide for a refrigerated case for storage and presentation of food products (such as perishable meat, dairy, seafood, produce, etc.). Such known refrigerated cases may include those of a type typically having an open front to permit consumers to reach in and select products from shelves within the case (e.g. "self service" type cases, etc.). Open-front refrigerated cases often have an "air curtain" extending across the front of the case and is made of one or more layers of refrigerated air that flow downwardly from a discharge along a top front portion of the case and is drawn into a return along a lower front portion of the case (for example, at or inside of a front "bumper" of the case). The air curtain is intended to form an "invisible boundary" between the product display area within the case and the ambient air surrounding a front of the case. The invisible boundary of the air curtain is intended to minimize "mixing" of surrounding ambient-temperature air with the chilled air within the case and behind the air-curtain. However, the warmer ambient air surrounding the case tends to become entrained within the air curtain, becoming cooled by the air curtain and tends to "spill" or flow down over the front of the case.

Such open-front cases having an air curtain often include at least one layer (e.g. a "primary" layer) of air that is refrigerated or chilled by the case and discharged downwardly across a front of the case. Such open-front cases may also include a second or third layer of air (e.g. "secondary" and "tertiary" layers) adjacent the primary layer to help improve the efficiency of the primary layer of air in the air curtain. These secondary or tertiary layers are often formed using a fan that pulls ambient air from above the refrigerated case and discharges such ambient air outwardly adjacent to the primary layer. However, such known air curtains for open-front cases have certain disadvantages. For example, ambient air that becomes chilled by the primary or refrigerated air curtain often "spills" over the front bumper of the case and is not returned to the case for continuing use in the air curtain and is typically "lost" to the ambient environment. Further, using ambient air (or air that is slightly warmer than the ambient environment) as a secondary or tertiary layer is less likely to improve the efficiency of the primary layer of air in the air curtain than if the secondary or tertiary layer was at least slightly cooler than the ambient environment.

Accordingly, it would be desirable to provide a refrigerated case with an open front having an air curtain with a primary layer formed from air refrigerated by the case. It would also be desirable to provide an air curtain system having a secondary layer of air formed from air cooled by exposure to the primary layer and that is not returned to the primary layer. It would further be desirable to provide an air curtain system having a primary layer of refrigerated air and a secondary layer of air formed from the air cooled by exposure to the primary layer and that spills over a front bumper of the case. It would also be desirable to provide an air curtain system having a primary layer of air refrigerated by the case and a secondary layer of "cool" air that is recycled from a front of the case for use in providing a "buffer" layer of air having a temperature lower than an ambient temperature. It would be also be desirable to provide an air curtain system that provides supplemental (e.g. additional or further) cooling of the recycled ambient air that forms the secondary curtain. It would be further desirable to provide an air curtain system that dehumidifies the recycled ambient air that forms the secondary air curtain.

Accordingly, it would be desirable to provide an air curtain system for a refrigerated case having an open-front and air curtain having any one or more of these or other advantageous features.

SUMMARY

The present invention relates to an air curtain system for a refrigerated case of a type having an open front and an air curtain with a primary refrigerated layer of air circulating across the open front. An air flow path in the form of a plenum is provided in the case and has an inlet opening proximate a front lower surface of the case and an exit opening outwardly adjacent to a discharge opening for the primary layer. An air flow device such as a fan is provided in the plenum, or in a separate duct(s) interfacing with the plenum, to draw a source of cooled ambient air from a region external to a front of the case for circulation as a secondary air curtain outwardly adjacent to the primary air curtain. The source of cooled ambient air is ambient air that is cooled by exposure to the primary layer and spills over the front of the case. The secondary layer provides a buffer between the primary layer and ambient air surrounding the open front of the case. The secondary layer is formed from air having a temperature that is less than the temperature of the ambient air. The plenum may be provided along a rear structural portion of the case. The plenum is configured to direct the source of cooled ambient air over bottom and/or rear surfaces of the case that tend to accumulate moisture or condensation so that the source of cooled air tends to eliminate condensation on the surfaces. A local cooling device and/or a dehumidification device may be located within the plenum and intended to reduce the temperature and/or humidity of the air that forms the secondary air curtain. A duct may interface with the plenum to divert at least a portion of the flow of ambient air from the plenum to a remote cooling device and/or a dehumidification device and then back to the case to reduce the temperature and/or humidity of the air that forms the secondary air curtain. The remote cooling device and/or a dehumidification device may be dedicated for use with a single case or may interface with a network of ducts to provide cooling and/or dehumidification of air for use by multiple cases. The remote cooling device and/or dehumidification device and duct may be part of an originally manufactured case, or may be added to existing cases as a retrofit option (such as connection of a remote cooling and/or dehumidification device and duct(s) to one or more existing cases. A heat pipe may be used as a local or remote cooling device and/or dehumidification device.

The present invention also relates to an open-front refrigerated display case of a type having an air-curtain with a refrigerated primary layer exiting downwardly from a first opening at a top front of the case and extending at least partially across an open front of the display case. A secondary layer for the air curtain is formed from ambient air cooled by exposure to the primary layer that spills over a front of the case and is drawn into a plenum for discharge from a second opening adjacent to the first opening. The plenum extends along at least a bottom portion and a rear portion of the case. The plenum may be formed during construction of the case or added (e.g. retrofitted, etc.) onto an existing case. Either one or both of the first and second openings may include a honeycomb structure for directing flow of air in the air curtain. The primary layer may be directed downwardly across a front of the case and the secondary layer may be directed downwardly adjacent the primary layer or outwardly (at any suitable angle) with respect to the primary layer. The first and/or second openings may be at a top front portion or a top rear portion of the case. The secondary layer is formed from air spilled over a front bumper of the case and has a temperature between the refrigerated primary layer and the ambient temperature. A tertiary layer may be added to the air curtain and formed from ambient air surrounding the case at an ambient temperature. The air curtain may also be used to flow over the outside surface of a refrigerated case having a door to enhance condensation reduction on the door.

The present invention also relates to a method of providing an air curtain for use with an open-front refrigerated display case. The method includes the following steps: (1) providing a first flow path within the case configured to refrigerate or otherwise chill and circulate a primary layer of air across an open front of the case, (2) providing a second flow path configured to draw-in ambient air cooled by the primary layer from a region external to a lower front face of the case and discharge the cooled ambient air in the form of a secondary layer adjacent to the primary layer. The method may also include the steps of providing an airflow device within the second flow path to circulate the cooled ambient air, and forming the second flow path as a plenum within a rear of the case. The method may also include recycling or returning ambient air that is cooled by the primary layer and that spills over a front bumper of the case for suction into the second flow path.

DETAILED DESCRIPTION

Figure 1:
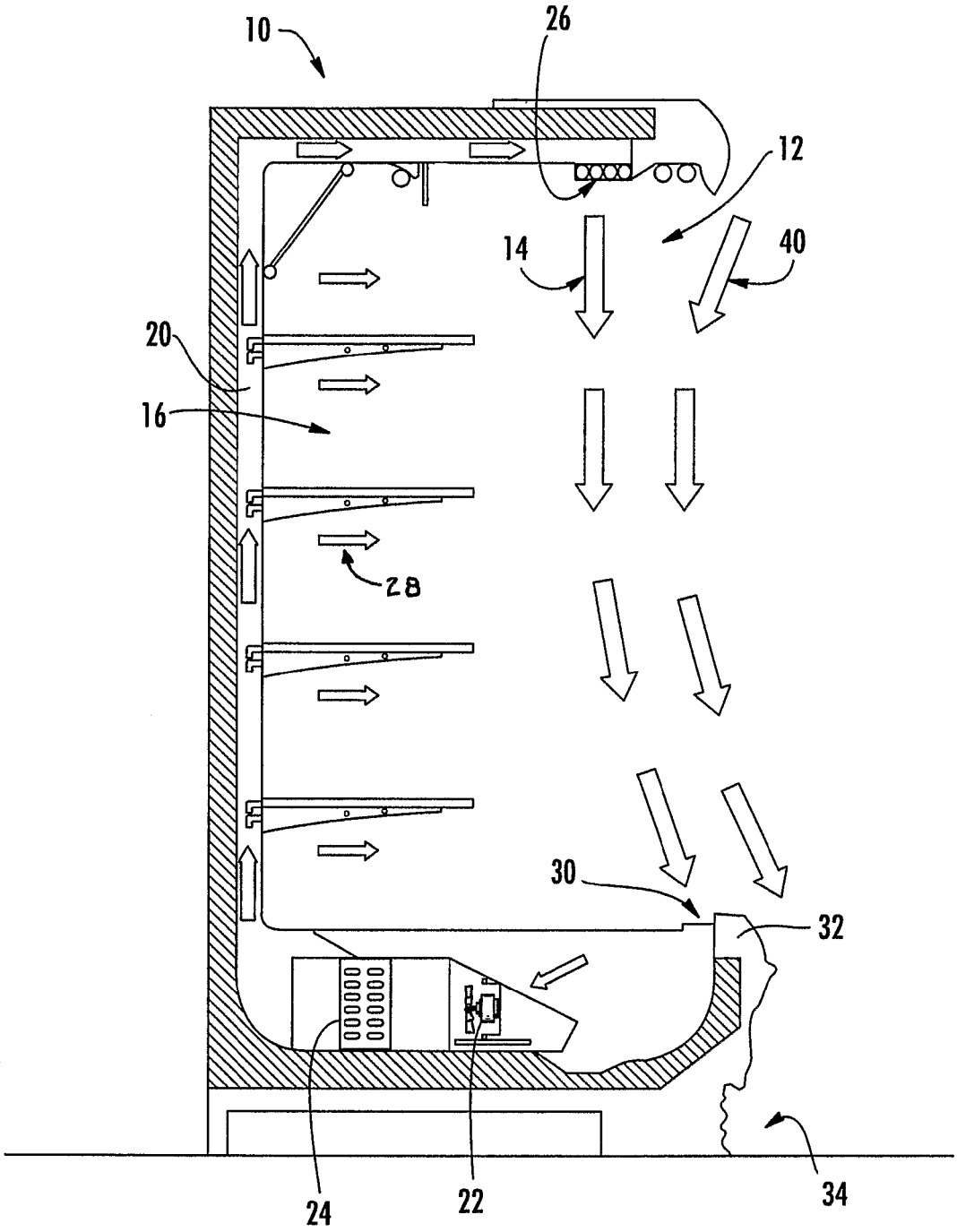
FIG. 1 (PRIOR ART)
FIG. 1 is a schematic representation of a side elevation view of a refrigerated case having an air curtain with a primary refrigerated layer.

Referring to FIG. 1, a typical front-loading refrigerated case 10 of the open-front type with an air curtain 12 (e.g. air stream, etc.) is shown having a single refrigerated layer 14 of air. The function of the air curtain is intended to provide a boundary to separate an interior refrigerated portion 16 (e.g. product display area, etc.) of the case from an external ambient environment surrounding the case (e.g. supermarket atmosphere, etc.). Such cases with an air curtain 12 having a refrigerated layer 14 include a first flow path 20 having an airflow device (shown as fan 22) and a refrigeration or cooling device (shown as a cooling coil 24) for chilling or refrigerating air that is discharged from an exit opening 26 shown along a top front portion of the case. Note that the refrigerated air from the first flow path may also be discharged into the product storage area at one or more locations 28 to provide a source of cooling to products stored within the area.

The refrigerated layer 14 is discharged from exit opening 26 and extends downwardly along an open front of case 10 to provide an "invisible thermal boundary" between the product storage area 16 and the external ambient environment surrounding the case. As the refrigerated layer 14 of air approaches a lower portion of the open front of the case (at an increased "return temperature") the air is drawn into an inlet opening 30 (e.g. return opening, suction opening, etc.) shown for example as located inside a front bumper 32 of case 10. The returned air from refrigerated layer 14 is drawn across cooling coil 24 by fan 22 and discharged from exit opening 26 to continue the air curtain process.

Referring further to FIG. 1, ambient (i.e. typically warmer) air 40 proximate the open front of the case is generally understood and believed to become "entrained" by, or otherwise exposed to, interface with, or associated with, the refrigerated layer 14 of air in the air curtain. The ambient air tends to be "cooled" by interaction with the refrigerated air of primary layer 14 to a temperature in a range between the temperature of the ambient air and the temperature of the refrigerated air layer and tends to "fall" or flow downwardly by gravity (i.e. the tendency of cooler, heavier air to "sink") and/or the downward velocity effects from the air flow of the refrigerated layer 14 circulating between exit opening 26 and inlet opening 30. At least a portion of the cooled ambient air tends to "spill" or flow over the front face of bumper 32 and accumulate in a region 34 proximate a bottom front of the case where the cooled ambient air is typically "lost" or otherwise not recovered or used to improve the thermal performance of typical refrigerated display cases.

Figure 2:
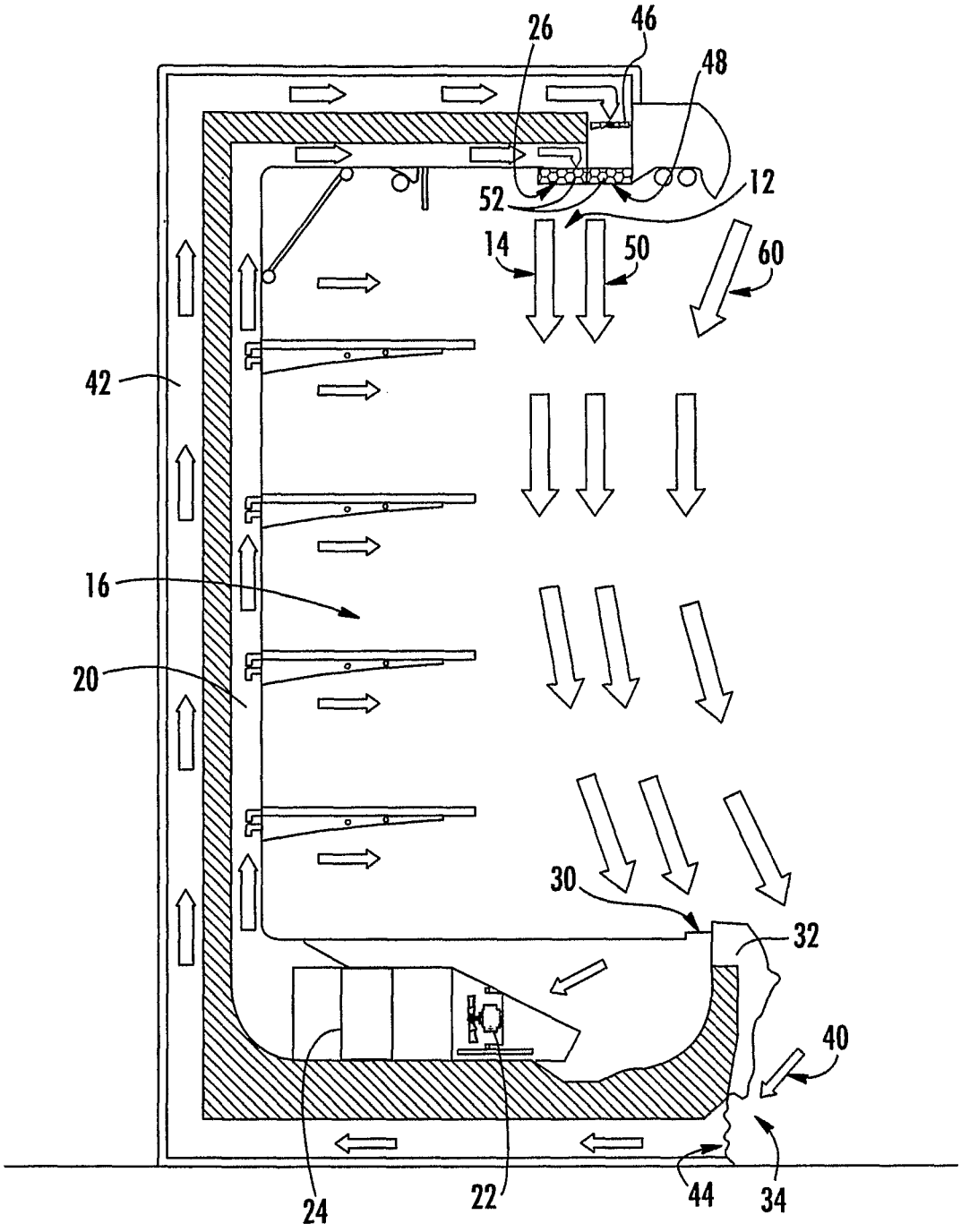
FIG. 2 is a schematic representation of a side elevation view of a refrigerated case having a secondary layer of air formed from ambient air cooled by interfacing with the primary refrigerated layer, according to an exemplary embodiment.

Referring to FIG. 2, the basic elements and assemblies of a refrigerated case are shown according to one embodiment for a refrigerated case of the front-loading, open-front type (e.g. "reach-in," "self-service," etc.) having an "air curtain" with one or more layers of air for maintaining the temperature of refrigerated products (e.g. meat, fish, dairy, deli, produce, etc.). The air curtain 12 is shown flowing downwardly over the open front of the case and is intended to enhance the performance of the refrigerated case by providing a boundary or separation between the refrigerated interior 16 of the case and the warmer ambient environment external to the case.

According to the illustrated embodiment, air curtain 12 is shown having a single refrigerated layer 14 of air (e.g. a primary layer) flowing through a first flow path 20 between an inlet/suction opening 30 and an outlet/discharge opening 26 and refrigerated by a fan 22 and coil cooling element 24. According to an alternative embodiment, multiple refrigerated layers may be used having suitable flow paths for refrigerating and directing the flow of the refrigerated layers in the air curtain over the open front of the case.

Another flow path (e.g. a second flow path according to the illustrated embodiment—shown as plenum 42) is provided and includes an inlet/suction/return opening 44 located generally along a front lower face of the case and proximate the region 34 of cooled ambient air that tends to spill over front bumper 32. The plenum may be built into the case during construction and routed along surfaces that tend to accumulate moisture or condensation (e.g. "sweat" etc.), alternatively, the plenum may be added onto existing cases as a retrofit installation. An airflow device, shown as a fan 46 is provided within plenum 42 (shown for example near an outlet/discharge opening 48, but may be provided at any suitable location). The fan 46 is intended to "draw" the cooled ambient air 40 from region 34 near the front bottom of the case and "recycle" the cooled ambient air by discharging it as a "buffer" layer of cooled ambient air (shown schematically, for example, as a secondary layer 50) outwardly adjacent to the refrigerated layer (shown as a primary layer 14). The secondary layer 50 of cooled ambient air provides a layer of air next to the refrigerated layer(s) that has a lower temperature than the ambient air to reduce the temperature gradient of the refrigerated layer(s) and reduce its return temperature to improve the overall performance of the case. The secondary layer 50 acts as a "buffer" or intermediary in air curtain 12 that does not require refrigeration by the case, yet recycles cooled ambient air 40 to help "separate" the refrigerated layer(s) of the air curtain from the ambient air surrounding the case. The ambient air 60 surrounding the case is generally understood to become entrained or to otherwise interact with the air of the secondary layer 50, but to a lesser degree than it would otherwise interact with a refrigerated layer, and is believed to reduce the thermal degradation and flow instability of the refrigerated layers.

The secondary layer 50 of cooled ambient air 40 also tends to retain its effectiveness during defrost cycles of cooling coil 24, because the second flow path/plenum 42 is configured to be independent of cooling coil 24 and the temperature of the secondary air layer 50 is not directly dependent upon cooling coil 24. Accordingly, the secondary layer is intended to retain a degree of independence from the thermal characteristics of the case during defrosting operation.

The speed/capacity of fan 46 may be adjusted to suit the environment and thermal characteristics of a particular case. For example, the fan speed/capacity may be "tuned" to draw in a sufficient flow rate of air to "collect" substantially all of the cooled ambient air 40 from region 34, while minimizing the introduction of ambient air that has not been cooled by the refrigerated layer(s). Such adjustments may be made at a factory, or at a jobsite, and may be accomplished by providing multiple fans that may be selectively started or stopped, or by providing variable speed fans, or other suitable control scheme. By further way of example, the plenum 42 may include temperature sensing devices (e.g. thermocouples, RTDs, thermistors, etc.—not shown) configured to sense and provide a signal representative of the temperature of the cooled ambient air to a control device (e.g. microprocessor, programmable logic controller, etc.—not shown) for adjusting (e.g. increasing or decreasing) the flow rate of the air for the secondary layer of the air curtain.

Figure 3:
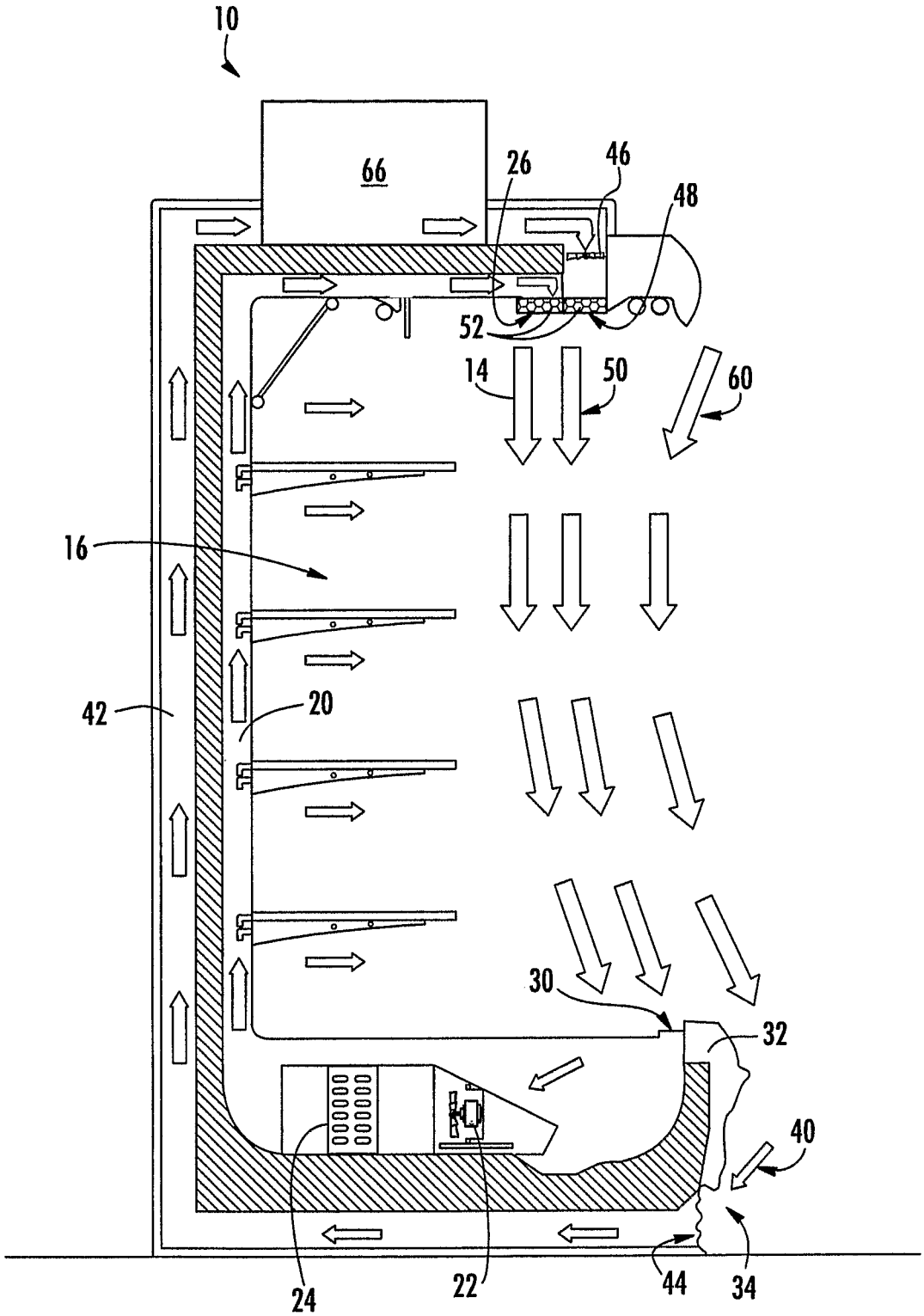
FIG. 3 is a schematic representation of a side elevation view of a refrigerated case having a secondary layer of air formed from ambient air cooled by interfacing with the primary refrigerated layer and further cooled and/or dehumidified by a local supplemental cooling and/or dehumidifying device within the case, according to an exemplary embodiment.
Figure 4:
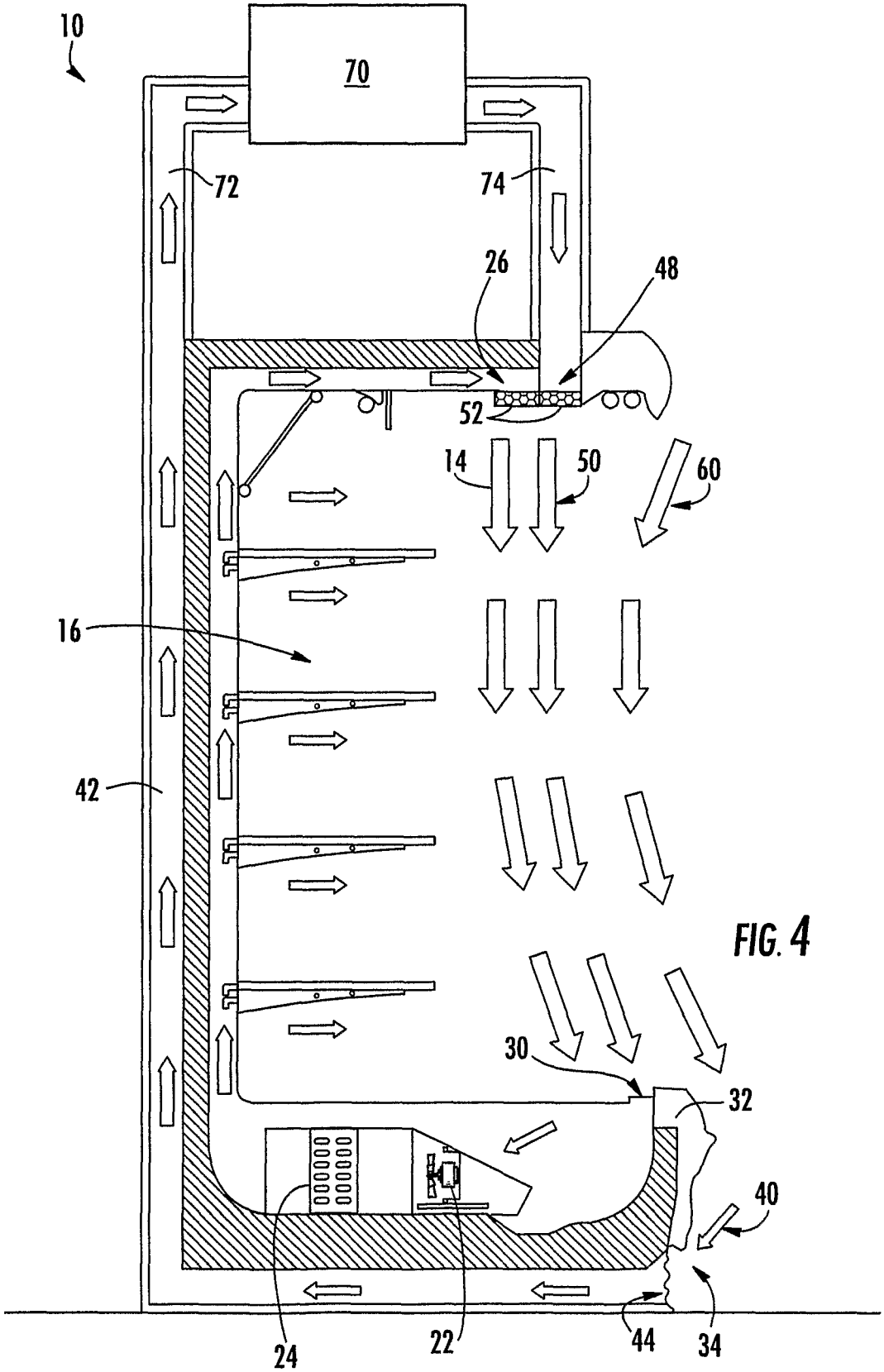
FIG. 4 is a schematic representation of a side elevation view of a refrigerated case having a secondary layer of air formed from ambient air cooled by interfacing with the primary refrigerated layer and further cooled and/or dehumidified by a remote supplemental cooling and/or dehumidifying device and duct interfacing with the case, according to an exemplary embodiment.

Referring further to FIGS. 2-4, outlet/discharge openings may include airflow diffusers 52 (e.g. "honeycombs" etc.) for directing a flow of air in respective layers of the air curtain. According to the illustrated embodiment, outlet/discharge openings 26, 48 are located at a top front region of case 10 and are substantially adjacent and configured to direct the layers 14 and 50 of air curtain 12 in a substantially parallel flow pattern. According to alternative embodiments, the outlet/discharge openings may be located at any suitable location to provide an air curtain, such as at a top rear of the case, and may be separated, or configured to direct air in a non-parallel flow pattern (e.g. the secondary layer may be directed at an angle extending outwardly from the refrigerated layer(s).

Referring to FIGS. 3 and 4, an air curtain system having supplemental cooling and/or dehumidification capability is shown according to exemplary embodiments.

According to one embodiment illustrated schematically in FIG. 3, an open-front type refrigerated case 10 having a secondary air curtain 50 formed from cooled ambient air is provided (as previously described with reference to FIGS. 1 and 2). Case 10 is also shown to include a "local" cooling and/or dehumidification device 66 (e.g. air handling unit, etc.) generally integrated with plenum 42 to reduce the temperature and/or humidity of the air drawn in through opening 44 that forms the secondary air curtain. The device 66 may be a cooling coil (with or without "fins"), fan-coil unit, chiller (or the like) intended to reduce the temperature and humidity of the ambient air flowing through plenum 42 before exiting from discharge opening 48 (in front of the primary air curtain 14) to increase the performance of the secondary air curtain 50. According to one embodiment, a fan may be provided within the duct(s) or in connection with the device (e.g. fan-coil unit, etc.) so that a separate fan (such as fan 46 as shown in FIG. 2) may be omitted. Device 66 is intended to receive a source of coolant (e.g. refrigerant, etc.) such as from coil 24, or other suitable supply. Device 66 is shown for example as located along a top panel of case 10, but may be located at any suitable place along the plenum to suit an intended application (e.g. beneath the case, along a back panel of the case, etc.) and may include appropriate accessories such as (but not limited to) a reservoir and drain tube for capturing and draining condensate, dampers, electrical controls, etc. According to another embodiment, the device 66 may include a separate dehumidification device (such as, but not limited to, liquid desiccant, desiccant wheel, etc.) to provide additional dehumidification and which may be used alone (e.g. without a separate cooling device) in certain applications where dehumidification alone is desirable.

Referring to FIG. 4, an open-front type refrigerated case 10 having a secondary air curtain 40 formed from cooled ambient air (such as previously shown and described) is shown to include a "remote" cooling and/or dehumidification device 70 (e.g. air handling unit, etc.) shown located remote from case 10 and interconnected to plenum 42 by suitable flow passages (shown as ducts 72 and 74). According to one embodiment, device 70 is substantially similar to device 66 (shown in FIG. 3—but may have certain variations such as increased capacity for use with multiple cases, etc.) and is also intended to reduce the temperature and/or humidity of the air that forms the secondary air curtain, but may be located remotely from the case (such as a "common" or "central" device for interfacing with multiple cases, or installation as an "add-on" or retrofit application for existing cases, etc.). Device 70 is shown to interface with plenum 42 through a supply duct 72 and a discharge duct 74 to direct at least a portion of the flow of the ambient air from intake 44, through plenum 42, to device 70, and to discharge opening 48 (or to a suitable portion of the plenum upstream of the discharge opening). As shown in FIG. 4, return duct 74 may be integrated with discharge opening 48 to minimize reworking of the case in retrofit applications.

The supplemental cooling systems shown according to exemplary embodiments in FIGS. 3 and 4 are intended for use with a primary refrigerated air curtain (such as air curtain 14 in FIGS. 1 and 2), or also with a third ambient air curtain (e.g. without supplemental cooling—not shown).

According to an alternative embodiment, the ducts and cooling device may be provided in a parallel flow relationship with a segment of the plenum and a flow control device (e.g. damper, etc.) and suitable controls may be provided to control positioning of the flow control device to increase flexibility of the system so that supplemental cooling may be manually or automatically regulated (e.g. by a control system or the like) based on certain conditions (e.g. environmental conditions within the store, seasonal climate changes, product loading of the case, cyclical consumer traffic/demand periods, etc.). Alternatively, a flow control device may be provided with the cooling and/or dehumidification device for regulating or balancing the parallel flow of ambient air through the plenum and the ducts to provide a desired amount of "mixing" (i.e. air flow through the ducts that is cooled by the device, and air flow through the plenum that "bypasses" the device).

According to any exemplary embodiment, the air curtain system for a refrigerated case is intended to take advantage of ambient air that is cooled by a refrigerated layer(s) of the air curtain (or other portion of the refrigerated device) and "reuse" or "recycle" the cooled ambient air for use as an additional, "outer" layer of the air curtain to help improve the performance of the case by reducing the temperature gradient of the refrigerated layer(s) and lowering the air return temperature, and acting as a buffer layer with the ambient air to improve the stability of the refrigerated layer(s), and route the air through a plenum configured to reduce accumulation of moisture or condensation on or in the case. The cooled ambient air tends to spill over a front edge (e.g. bumper) of the case and is "collected" along a region adjacent to a lower front exterior of the case by drawing the air into a flow path or plenum for directing and discharging the cooled air outwardly adjacent to the refrigerated layer(s). The layer of cooled ambient air may be discharged substantially parallel to the refrigerated layer(s) or may be discharged at any suitable angle away from the refrigerated layer(s). The performance of the air curtain system may be enhanced by providing supplemental cooling through a cooling and/or dehumidification device that is integrated locally with the plenum and/or case, or can be located remotely from the case and interconnected by suitable flow passages and/or controls to provide supplemental cooling and/or dehumidification to the ambient air is drawn into the plenum and then discharged to form the secondary air curtain.

According to any alternative embodiment, the air curtain system may be used in connection with an enclosed refrigerated device (e.g. having transparent doors, panels, etc.) so that the air curtain extends along an exterior surfaces of the door(s) or panel(s) to minimize fogging, condensation or other accumulation of moisture. For example, the air curtain may use relatively low temperature and/or low humidity air for discharge along the front of the case. The air may be cooled and/or dehumidified by a dedicated system, or may be provided by the cooling system for the refrigerated device, etc. Accordingly, all such variations for use of the air curtain system with enclosed cases are also intended to be included within the scope of this disclosure.

According to another alternative embodiment, other sources of cooling and/or dehumidification may be used to further cool and dehumidify the air for use in the secondary air curtain. For example, heat pipe technology may be used in the outer plenum 42 (or in duct work such as ducts 72, 74) to lower the temperature and/or humidity of the air circulating therethrough for discharge as the secondary air curtain. Generally, the heat pipe system may be used to extract heat from the secondary curtain air flow and transfer the heat to a heat sink or cold source such as an evaporator or chilled compartment of the refrigerated case, or into the air flowing within the inner plenum 20, or to an external cold source such as an air conditioning system for the facility (e.g. across the coils, or in the plenum, ductwork, discharge, etc.). The heat pipe system may include a sealed system having an evaporator (e.g. the cooling device in the air flow stream for the secondary curtain) interconnected to a condenser (e.g. the heat exchanger interfacing with the cold source) and made from a thermally conductive material such as copper, aluminum, etc. and having a suitable working fluid (e.g. methanol, ethanol, toluene, water, etc.). The heat pipe system also includes provision for transport of the fluid within the sealed system. For example, the working fluid may flow by gravity (such as where the working fluid condenses at one elevation and flows by gravity to a lower elevation) or the working fluid may be transported through the use of a wicking device. The wicking device may be provided in the form of a porous wick contained within the system. The porous wick is preferably formed as a porous structure made from a material such as steel, aluminum, nickel, copper, carbon fiber, ceramic fiber, etc. and may be in the form of foams, felts, batts, etc. However, according to alternative embodiments, the working fluid may be transported or wicked by any suitable structure or system configuration, including but not limited to internal structure (e.g. channels, grooves, ribs, etc.) on the tubing or any other suitable arrangement. The heat pipe operates in an evaporation-condensation cycle through transport of the working fluid (such as through gravity flow or the use of capillaries in a wick material, etc.) to return the condensed working fluid from the heat exchanger at the cold source to the evaporator for cooling the air flow stream. Since a heat pipe is activated by a temperature difference (i.e. between the air flow stream and the cold source) and generally consumes no (or little) energy, it provides one attractive method for transferring heat from the air flow stream to a convenient cold source.

Accordingly all such types of cooling and/or dehumidification technology is intended to be within the scope of the disclosure.

It is also important to note that the construction and arrangement of the elements of the air curtain for a refrigerated case as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the plenum and its inlets, outlets, and airflow devices may be arranged in any suitable manner or otherwise varied to take advantage of the cooled ambient air, the length or width of the structures and/or members or connectors or other elements of the case may be varied, the angle and location of the cooled ambient air layer discharge may be varied to suit any desired application. By further way of example, additional layers of cooled air may be used in the air curtain system (e.g. two layers of refrigerated air may be provided and a cooled ambient air layer may form a third layer, etc.). Also, the air curtain system may be provided with or without supplemental cooling, and the supplemental cooling and/or dehumidification devices (where provided) may include any suitable equipment and controls for operating to reduce temperature and humidity. It should be noted that the elements and/or assemblies of the air curtain system for a refrigerated case may be constructed from any of a wide variety of materials that provide sufficient strength or durability, in any of a wide variety of colors, textures and combinations. Accordingly, all such modifications are intended to be included within the scope of the appended claims. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

What is claimed is:

1. A refrigerated display case comprising:

a housing having an open front and defining a space adapted to receive objects; a cooling system providing an air curtain with a refrigerated primary layer and a cooled secondary layer, the refrigerated primary layer exiting from a first opening and extending at least partially across the open front, the cooled secondary layer exiting from a second opening and formed of ambient air cooled by exposure to the refrigerated primary layer that is drawn into a duct within the housing after spilling over a front surface of the housing;

a dehumidification device separate from the cooling system and operatively coupled to the duct to provide dehumidification alone of the cooled ambient air drawn into the duct; and an adjustable airflow device operably communicating with the duct, wherein the adjustable airflow device can be tuned in response to the signal representative of the temperature of the cooled ambient air to collect substantially all of the ambient air cooled by exposure to the refrigerated primary layer after spilling over a front surface of the housing, while minimizing the introduction of ambient air that has not been cooled by the refrigerated primary layer;

wherein the air flow device comprises one or more variable speed fans;

wherein at least one of the cooling system and the dehumidification device comprises a heat pipe system; and wherein the heat pipe is used between a first flowpath inner plenum and a secondary flowpath outer plenum.

2. The refrigerated display case of claim 1 wherein the cooled secondary layer flows substantially parallel to the refrigerated primary layer across the open front.

3. The refrigerated display case of claim 1 wherein the duct is in fluid communication with an inlet opening located at a front surface below a bumper portion of the housing.

4. The refrigerated display case of claim 1 wherein the duct directs the cooled ambient air over surfaces of the housing over surfaces that tend to accumulate moisture so that the cooled ambient air reduces the moisture on the surfaces.

5. The refrigerated display case of claim 1 wherein the duct extends along at least a bottom portion and a rear portion of the housing.

6. The refrigerated display case of claim 5 wherein the duct further extends along a top portion of the housing.

7. The refrigerated display case of claim 6 wherein the first opening and the second opening are provided at a top front portion of the housing and the primary layer and the secondary layer are directed downwardly across the open-front.

8. The refrigerated display case of claim 1 wherein the air flow device comprises multiple fans that may be selectively started or stopped.

9. The refrigerated display case of claim 1 wherein at least one of the first opening and the second opening includes a diffuser for directing air flow.

10. The refrigerated display case of claim 1 further comprising a cooling device configured to provide the refrigerated primary layer.

11. The refrigerated display case of claim 10 wherein the cooling device is locally integrated with the housing.

12. The refrigerated display case of claim 1 further comprising a conduit system interfacing with the duct to divert at least a portion of the air flowing therein to the dehumidification device.

* * * * *